US008105638B2

(12) United States Patent
Harlfinger

(10) Patent No.: US 8,105,638 B2
(45) Date of Patent: Jan. 31, 2012

(54) RECLOSABLE PACKAGE FOR A PRODUCT

(75) Inventor: Charles Everett Harlfinger, Englewood, FL (US)

(73) Assignee: C-Pak, LLC, Taunton, MA (US)

( * ) Notice: Subject to any disclaimer, the term of this patent is extended or adjusted under 35 U.S.C. 154(b) by 677 days.

(21) Appl. No.: 11/600,601

(22) Filed: Nov. 16, 2006

(65) Prior Publication Data

US 2008/0118609 A1 May 22, 2008

(51) Int. Cl.
*A23B 7/148* (2006.01)

(52) U.S. Cl. ..... 426/106; 220/4.21; 220/784; 220/787

(58) Field of Classification Search ..... 220/783, 220/793, 4.24, 4.21, 780, 784, 787, 789, 220/791, 792; 426/119, 120, 121, 410, 411, 426/106

See application file for complete search history.

(56) References Cited

U.S. PATENT DOCUMENTS

| | | | | |
|---|---|---|---|---|
| 2,798,631 | A * | 7/1957 | Engel | 220/4.21 |
| 3,070,275 | A * | 12/1962 | Bostrom | 229/4.5 |
| 3,460,711 | A * | 8/1969 | Al-Roy | 220/781 |
| 3,464,832 | A | 9/1969 | Mullinix | |
| 4,124,141 | A * | 11/1978 | Armentrout et al. | 220/783 |
| 4,180,179 | A * | 12/1979 | Hoenig et al. | 220/783 |
| 4,555,056 | A * | 11/1985 | Bernhardt | 229/102 |
| 4,850,504 | A * | 7/1989 | Gindrod et al. | 220/787 |
| 4,944,134 | A | 7/1990 | Grindrod et al. | |
| 5,029,725 | A * | 7/1991 | Roth | 220/655 |
| 5,031,383 | A | 7/1991 | Hustad | |
| 5,129,517 | A | 7/1992 | Hustad | |
| RE34,347 | E | 8/1993 | VanErden et al. | |
| 5,507,406 | A * | 4/1996 | Urciuoli et al. | 220/269 |
| 5,651,462 | A | 7/1997 | Simonsen et al. | |
| 5,741,075 | A | 4/1998 | Collins et al. | |
| 6,701,993 | B2 | 3/2004 | Faherty | |
| 6,786,329 | B2 * | 9/2004 | Onishi | 206/209 |

(Continued)

FOREIGN PATENT DOCUMENTS

| | | |
|---|---|---|
| EP | 0385565 | 9/1990 |

(Continued)

*Primary Examiner* — Rena Dye
*Assistant Examiner* — C. A. Smith
(74) *Attorney, Agent, or Firm* — Wolf, Greenfield & Sacks, P.C.

(57) ABSTRACT

A package for packaging food and non-food products. The package may include a tray with a cavity to receive the product, and a reclosable lid to help protect the product within the tray. The lid may lock into an interior portion of the tray below its upper surface. The cavity may be sealed with a primary seal that helps to maintain the integrity of the product and/or to help preserve a food product within the cavity. A sealing flange used to form the primary seal is located below the upper surface of the tray and within the interior region of the tray. A removable sealing layer may be sealed to the sealing flange to form a hermetically sealed cavity. A secondary seal may be provided to help maintain freshness of a food product after the primary seal has been broken, and/or to stabilize or maintain the integrity of the package. One or more interlock features may be provided for releasably securing the lid to the tray. The interlocks may be located external to the cavity and within the interior region of the tray below its upper surface. The interlocks may include a snap-fit configuration that generates an audible sound that signals when the lid is secured to and/or removed from the tray.

39 Claims, 3 Drawing Sheets

U.S. PATENT DOCUMENTS

| | | | | |
|---|---|---|---|---|
| 6,883,678 | B2 * | 4/2005 | Chou | 220/793 |
| 6,991,375 | B2 | 1/2006 | Clune et al. | |
| 2003/0183540 | A1 | 10/2003 | Onishi | |
| 2003/0210837 | A1 | 11/2003 | Wedi et al. | |
| 2005/0053315 | A1 | 3/2005 | Aasen | |
| 2005/0244546 | A1 * | 11/2005 | Steffen | 426/106 |
| 2005/0257503 | A1 | 11/2005 | Fux | |
| 2006/0062496 | A1 | 3/2006 | Clune et al. | |
| 2006/0088677 | A1 | 4/2006 | Mathy et al. | |

FOREIGN PATENT DOCUMENTS

| | | |
|---|---|---|
| EP | 0579262 | 1/1994 |

* cited by examiner

RECLOSABLE PACKAGE FOR A PRODUCT

FIELD OF THE INVENTION

The present invention relates to a package for a product and, more particularly, to a reclosable package used for packaging and/or storing a product.

BACKGROUND OF INVENTION

Reclosable packages are commonly used for packaging or storing various products. Such packages may be used, for example, to package a product for sale to consumers or to store products at one's home or business. Reclosable packages may be used for sale or storage of food products. Reclosable packages may also be used for the sale or storage of non-food products such as mechanical fastening hardware, including screws, bolts, washers and nuts. Such packages may include a base or tray and a cover or lid that can be repeatedly opened and closed on the base.

Disposable food packages are commonly used for packaging various food products, such as meat and dairy products, for sale in supermarkets and other retail food outlets. Some food packages may include a rigid or semi-rigid tray that holds the food product and a cover or film that is placed over the tray and food product. Other food packages may include a flexible bag that is provided with a resealable closure device.

In one approach to packaging a food product, the tray is overwrapped with a sealing film by packers in the retail food market. Such packaging typically provides a limited product life as the package may not provide an airtight seal. This approach also involves additional labor at the retail outlet.

In another approach, a food product may be provided by wholesalers in case-ready packaging. The food product may be provided in a hermetically sealed package with an inert gas sealed within the package to help prevent spoilage of the food product. In this regard, the sealed package may provide a product life for the food product that is relatively longer than if the food product was not packaged in such a manner. The sealed package is ready for sale when it is delivered to the retail outlet.

It is an object of the present invention to provide a reclosable package for packaging food and/or non-food products.

SUMMARY OF THE INVENTION

In one illustrative embodiment of the invention, a package is provided for packaging for a product. The package comprises a tray including an upper peripherally extending surface, a cavity to receive the product therein, and a sealing flange that is to be used to form a first seal about the cavity. The sealing flange surrounds the cavity and is located below the upper surface within an interior region of the tray. The package further comprises a reclosable lid that is constructed and arranged to lock to an interior portion of the tray below the upper surface to cover the sealing flange and the cavity.

In another illustrative embodiment of the invention, a food package comprises a tray including a cavity and a sealing flange that extends about the perimeter of the cavity within an interior region of the tray. The cavity is adapted to receive a food product therein. The sealing flange is to form a primary seal that helps to maintain longer term preservation of the food product within the cavity. The food package further comprises a reclosable lid to cover the cavity and the sealing flange. The lid is constructed and arranged to engage with an interior portion of the tray to form a secondary seal about the cavity that helps to maintain shorter term preservation of the food product after the primary seal has been broken.

In a further illustrative embodiment of the invention, a method is provided for packaging a product. The method comprises acts of: (a) providing a tray that includes a cavity adapted to receive the product therein; (b) introducing the product into the cavity; (c) sealing the cavity along a first seal located about the cavity and within an interior region of the tray; and (d) covering the cavity and the first seal with a reclosable lid that engages an interior portion of the tray external to the cavity to removably secure the lid to the tray

BRIEF DESCRIPTION OF THE DRAWINGS

Various embodiments of the invention will now be described, by way of example, with reference to the accompanying drawings, in which.

DETAILED DESCRIPTION

Figure 1:
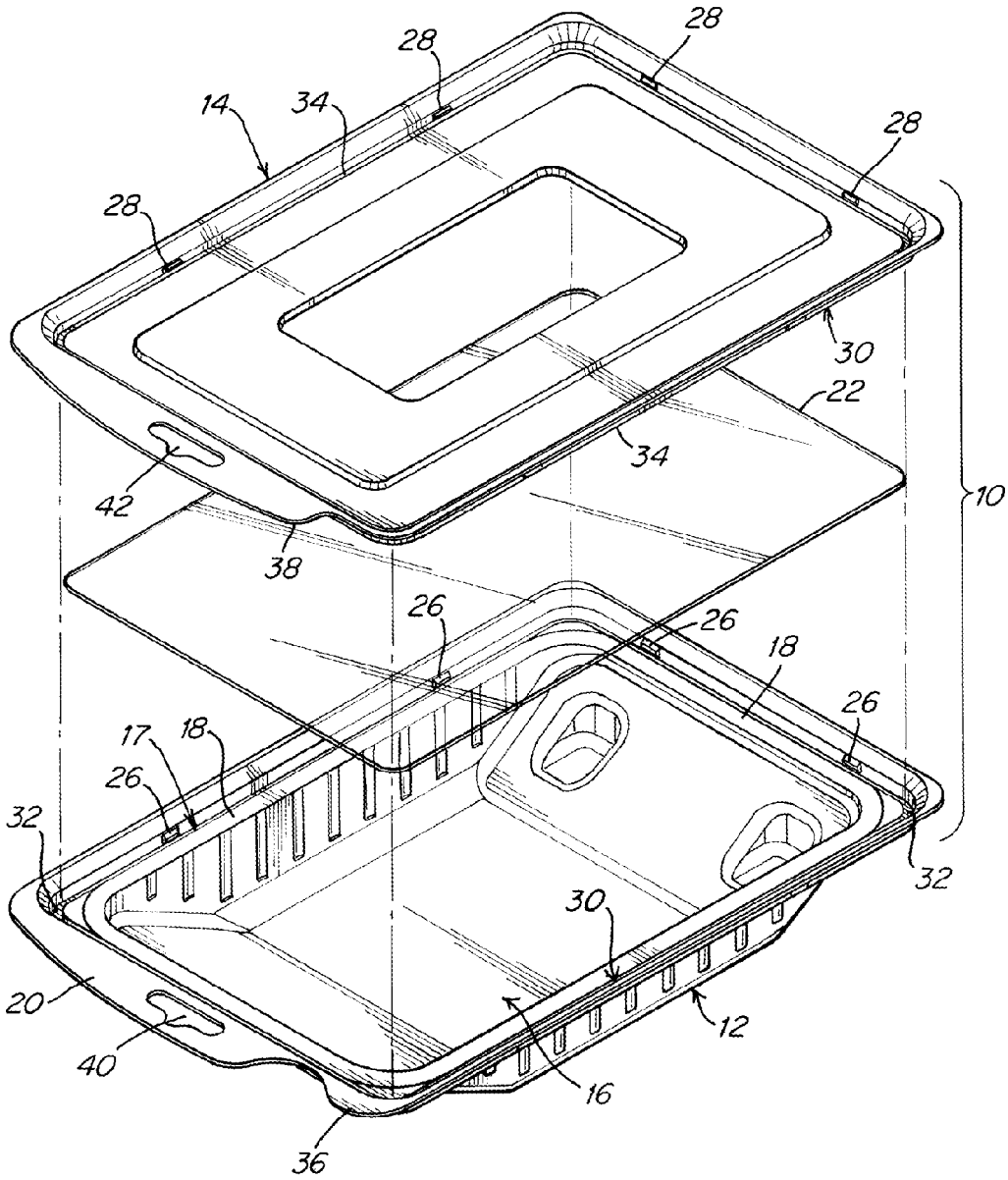
FIG. 1 is an exploded perspective view of a package according to one illustrative embodiment.
Figure 2:
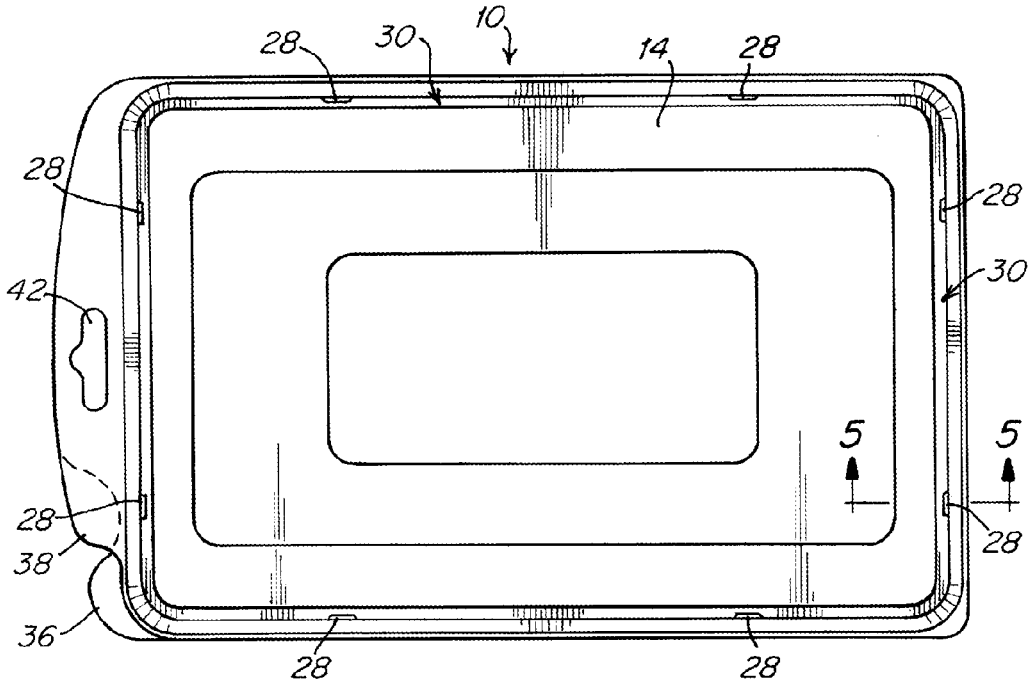
FIG. 2 is a top plan view of the package of FIG. 1.

The present invention is directed to a package for packaging various food and non-food products. The package may include a tray or base that is configured to receive the product, and a lid or cover that is securable to the tray to help protect the product within the tray. The lid may be reclosable so that a user or consumer may repeatedly open and close the package while the user or consumer is using or storing the product.

The package may have particular applications as a food package for protecting and preserving various food products including, but not limited to, meat and dairy products. When used for a food product, the package may be configured to maintain freshness of the food product over a period of time.

The tray may be provided with a preformed cavity that is adapted to receive the product therein. The cavity may be configured to have any desired shape that would be suitable for the particular product being packaged.

In some aspects, the cavity may be sealed with a first or primary seal that helps to maintain the integrity of the product. When used for packaging a food product, the primary seal helps to maintain longer-term preservation of the food product within the cavity. The primary seal may also help to prevent undetectable access to the cavity and the product stored therein. In this regard, the primary seal may help deter tampering or theft of the product stored in the package. In one embodiment, the primary seal may be formed with a sealing flange that surrounds the cavity. The sealing flange may be located below the upper surface or flange of the tray and within the interior region of the tray.

In some aspects, the lid may be configured to engage with or lock to an interior portion of the tray to cover the cavity and sealing flange. In one embodiment, the lid engages an interior portion of the tray below its upper surface or flange. The package may include at least one interlock for releasably securing the lid to the tray. The interlock may be located external to the cavity and within the interior region of the tray below its upper surface. The interlock may include a snap-fit configuration that generates an audible sound that signals to the user or consumer when the lid is secured to and/or removed from the tray. The tray may include one or more tray interlocks and the lid may include one or more lid interlocks that are configured to mate with each other to releasably secure the lid to the tray. A plurality of interlocks may be spaced intermittently about the cavity. It is to be appreciated that interlocks are not required for each embodiment of the package.

In some aspects, the package may include a removable sealing layer that is configured to overlie the cavity and to be sealed to the sealing flange to form a hermetically sealed cavity. Use of a sealing layer may have particular applications for packaging a food product. In one embodiment, the sealing layer may be fabricated from a flexible plastic film that is capable of being heat sealed to the sealing flange. The sealing layer may be readily peeled from the tray by the user or consumer to access the product in the tray cavity. However, it is to be appreciated that a sealing layer is not required for each embodiment of the package.

In some aspects, the package may be provided with a secondary seal that helps to stabilize or maintain the integrity of the package. When used for packaging a food product, the secondary seal may help to maintain shorter-term preservation of the food product within the cavity after the primary seal has been disturbed or broken by reducing the flow of air and/or moisture to and from the cavity. In this manner, the product life cycle of the food product may be extended for a period of time while a consumer is using the product.

In one embodiment, the package may employ an interference fit between the lid and the tray that forms the secondary seal when the lid is secured to the tray. The secondary seal may be established using a tongue and groove-like arrangement between the tray and lid that helps to seal and stabilize the package. However, it is to be appreciated that a secondary seal is not required for each embodiment of the package.

In some aspects, the package may include one or more tabs on the tray and/or lid to facilitate separation of the lid from the tray. In one embodiment, the tray and the lid include offset tabs that allow a consumer to more easily pull and separate the lid from the tray. It is to be understood, however, that separation tabs are not required for each embodiment of the package.

In some aspects, the package may be configured so that it can be hung for display or storage. In one embodiment, the package may include one or more apertures through the tray and/or lid so that the package may be hung for display at the point of purchase. However, it is to be appreciated that a feature for hanging the package is not required for each embodiment of the package.

The tray and lid may be fabricated as rigid or semi-rigid structures depending upon the particular application for the package. The tray and/or lid may be configured to have any suitable shapes desired for the particular product being packaged. The package may be produced using a preformed tray and lid on tray sealing type equipment or by forming the tray and lid on thermoform-fill-seal equipment.

For ease of understanding, and without limiting the scope of the invention, the package is described below as having particular applications for packaging a food product. It is to be understood, however, that any one or combination of the various features of the package described below may be incorporated into a package having applications that involve packaging or storing non-food products.

In one illustrative embodiment shown in FIGS. 1-4, the package 10 includes a tray 12 and reclosable lid 14 that is configured to be releasably secured to the tray. In this manner, the package 10 may be repeatedly opened and closed by the user or consumer to use or store food or non-food products. The tray 12 is provided with a cavity 16 that is configured to receive the product that is to be packaged or stored by the package.

To help maintain the integrity of the product, the package 10 may be provided with a first or primary seal 17. When used for packaging and preserving a food product, the primary seal helps to prevent spoilage of the food product and maintain its freshness for a period of time that is relatively longer than if the food product was not packaged in such a manner. The primary seal may also help to prevent undetectable access to the cavity and the product stored therein. In this regard, the primary seal may help deter tampering with or theft of a product stored in the package.

Figure 3:
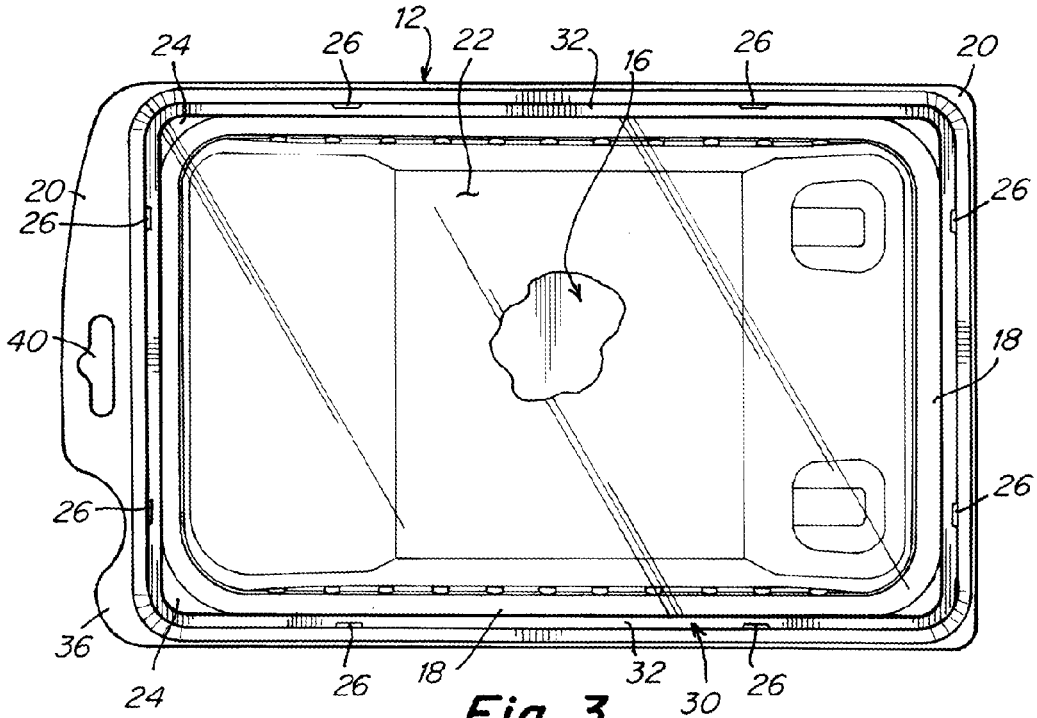
FIG. 3 is a top plan view of the package of FIG. 1 with the lid removed to illustrate the tray.
Figure 4:
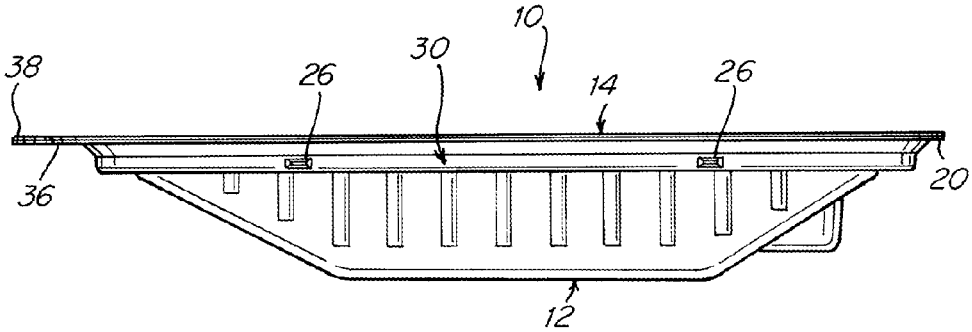
FIG. 4 is a side elevational view of the package of FIG. 1.
Figure 5:
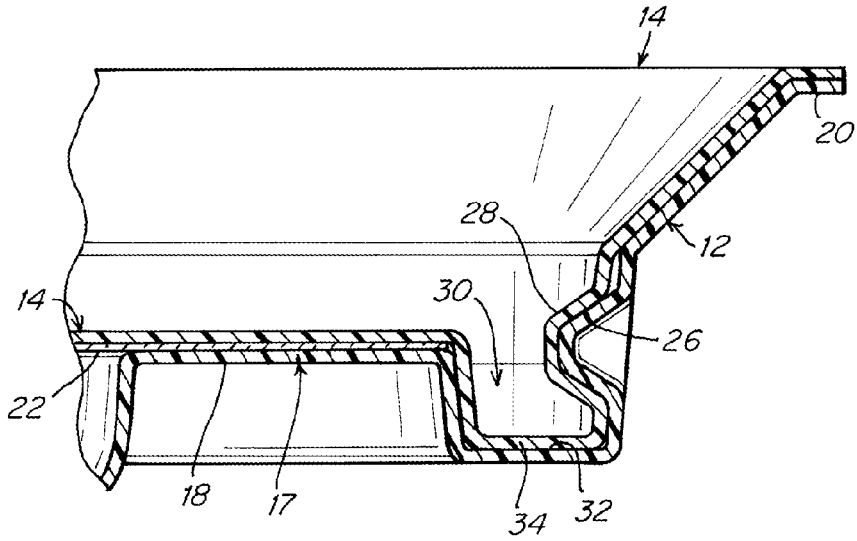
FIG. 5 is an enlarged cross-sectional view of the package taken along section line 5-5 of FIG. 2 illustrating package seals and an interlock connection between the lid and the tray according to one illustrative embodiment.

In one illustrative embodiment shown in FIGS. 1 and 3, the tray 12 includes a sealing flange 18 that extends about and surrounds the cavity 16. The sealing flange 18 is located within an interior region of the tray and below an upper peripheral surface or flange 20 of the tray as best illustrated in FIG. 5. As shown, the sealing flange 18 has a raised shelf-like configuration with a width of approximately 0.20 inches. However, it is to be appreciated that the sealing flange 18 may have any suitable configuration and size as would be apparent to one of skill in the art.

For applications involving the packaging a food product, it may be desirable to hermetically seal the cavity to help preserve the food product in the cavity. In one illustrative embodiment as shown in FIGS. 1 and 3, the package 10 may include a sealing layer 22 that is configured to overlie the cavity 16 and to be sealed to the sealing flange 18 to form a hermetically sealed cavity. The sealing layer 22 may be sealed to the tray 12 using a sealing plate that is pressed against the sealing layer at a desired temperature and/or pressure for a predetermined dwell time sufficient to seal the sealing layer 22 to the sealing flange 18. In this regard, the cavity 16 may be sealed with the sealing layer 22 using conventional packaging equipment known in the art. If desired, a laminate coating may be provided on the sealing flange 18 and/or the sealing layer 22 to facilitate the sealing process. However, it is to be appreciated that the cavity of the package may be sealed, if desired, using other suitable arrangements as would be apparent to one of skill in the art.

The sealing layer 22 may be configured to be readily removed from the tray 12. In one illustrative embodiment, the sealing layer 22 may be configured to be peeled from the tray. As shown in FIG. 3, the sealing layer 22 may sealed in a manner that one or more corners 24 of the sealing layer are not fully sealed to the sealing flange 18 such that a corner 24 of the sealing layer 22 may be lifted and pulled away from the tray 12 to peel the sealing layer from the cavity 16.

For some applications, it may be desirable to seal the cavity 16, either hermetically or non-hermetically, without the use of a separate sealing layer. For example, it may be desirable to seal the cavity in a manner that restricts easy or undetectable access to the cavity, for example, to deter tampering with and/or theft of a product. In one illustrative embodiment, the package may be configured so that the lid 14 is sealed directly against the sealing flange 18 to form a sealed cavity that cannot be accessed without breaking the seal.

As illustrated, the lid 14 is configured to cover the cavity 16 and the sealing flange 18 when it is secured to the tray 12. In one illustrative embodiment shown in FIG. 5, the lid 14 is configured to securely engage an interior portion of the tray 12 that is located below the upper surface or flange 20 of the tray to maintain the lid on the tray. In one embodiment, the lid 14 is configured to be snap-fit into the interior portion of the tray below the upper surface or flange 20 of the tray. Although illustrated as a separate part, it is to be understood that the lid 14 may be provided as an integral part of the package. For example, the lid 14 may be hinged to the tray in a manner as would be apparent to one of skill in the art.

The package 10 may include one or more interlocks that are configured to releasably secure the lid to the tray. Each interlock may be located external to the cavity at the interior portion of the tray engaged by the lid. In one illustrative embodiment shown in FIGS. 1-4, the package 10 includes a plurality of interlock features 26, 28 that are located about the cavity 16 and within the interior region of the tray. As shown in FIG. 1, the interlocks include a plurality of tray interlocks 26 and a plurality of lid interlocks 28 that mate with each other to releasably secure the lid to the tray. In the illustrative embodiment, the package 10 includes a pair of interlocks 26, 28 that are located outside the cavity 16 along each side of the sealing flange 18. It is to be understood, however, that the package may employ any number of interlocks that are located at any suitable location of the package as would be apparent to one of skill in the art. For example, the package may employ an interlock that extends continuously about the entire cavity within the tray.

In one illustrative embodiment best shown in FIG. 5, the lid interlocks 28 may have a female-like configuration and the tray interlocks 26 may have a male-like configuration that snaps into the lid interlock features. The interlocks 26, 28 may be configured to produce an audible sound when the lid 14 to secured to or removed from the tray 12 to signify to the user or consumer that the lid is securely closed on the tray. As shown, each interlock 26, 28 may have a generally U-shaped or V-shaped cross section that snap together when the lid is fully seated into the tray. In one embodiment, each interlock has a depth of approximately 0.04 inches and a length of approximately 0.21 to 0.22 inches. It is to be understood, however, that the package may employ interlocks having any suitable configuration as would be apparent to one of skill in the art.

In some applications, it may be desirable to provide the package with a secondary seal. When used to package a food product, the secondary seal may help to maintain shorter-term preservation of the food product after the primary seal has been compromised or broken. The secondary seal may be configured to inhibit or reduce the passage or flow of air and/or moisture to and from the closed package to help preserve the freshness of the food product.

In one illustrative embodiment shown in FIGS. 1, 3 and 5, the package 10 includes a secondary seal 30 that extends about and surrounds the sealing flange 18 and the cavity 16. The secondary seal 30 is located within the interior region of the tray 12 and below the upper surface or flange 20 of the tray. However, the secondary seal may be provided at any suitable region of the package as would be apparent to one of skill in the art.

The secondary seal 30 may be formed by an interference fit between the tray 12 and the lid 14 when the lid is secured to the tray. In the illustrative embodiment, the tray 12 is provided with a U-shaped channel or groove 32 that surrounds the sealing flange 18 and the lid 14 is provided with a complimentary U-shaped projection or tongue 34 that is configured to closely conform to and mate with the channel 32 to form the secondary seal. It is to be understood that the secondary seal, if desired, may be formed with any suitable configuration as would be apparent to one of skill in the art.

While the secondary seal 30 may reduce the flow of air and/or moisture to and from the cavity to help preserve the freshness of a food product, the seal may also help stabilize the package. In this regard, the illustrative interference fit may also enhance the structural integrity or rigidity of the package when the lid is secured to the tray.

The package 10 may be provided with one or more features to facilitate separation of the lid from the tray. In one illustrative embodiment shown in FIGS. 1-3, the package may include one or more tabs 36, 38 on the tray and/or lid to facilitate separation of the lid from the tray. In the illustrative embodiment, the tray 12 and the lid 14 include offset separation tabs 36, 38 that allow a user or consumer to pull and separate the lid from the tray. It is to be understood that the food package may implement separation features, if desired, having any suitable configuration as would be apparent to one of skill in the art.

The package 10 may be configured so that it can be hung for storage or display at the point of purchase. In one illustrative embodiment shown in FIGS. 1-3, the package may include one or more apertures 40, 42 through the tray and/or lid so that the package can be hung from a rack or other display at the point of purchase. In the illustrative embodiment, the tray 12 and the lid 14 both have an aperture 40, 42 that are configured to be aligned with each other when the lid is placed on the tray. As shown, the apertures are provided on the upper peripheral flanges of the tray and the lid. It is to be appreciated that the package may employ a hanging feature having any suitable configuration as would be apparent to one of skill in the art. It is contemplated that other embodiments of the package, such as standing or stackable packages, may not include a hanging feature.

The tray 12 and lid 14 may be fabricated as rigid or semi-rigid structures depending upon the particular application of the package. In this regard, the tray and lid may be fabricated from a rigid or semi-rigid plastic material including, but not limited to, polyethylene terephthalate (PET), amorphous polyethylene terephthalate (APET), or high impact polystyrene. The tray and lid may be fabricated as a single layer structure or a multi-layer structure using any suitable manufacturing processes including, but not limited to, thermoforming or injection molding. The tray and/or lid may be fabricated from a transparent material to allow visual inspection of the product, although a colored material may be used for the tray and/or the lid, if desired. It is to be understood, however, that the tray and/or lid may be fabricated using any suitable fabrication process and from any material suitable for the particular application as would be apparent to one of skill in the art.

The sealing layer 22, if used, may be fabricated using a flexible film material that may provide desirable various properties, such as strength, sealability and non-permeability, depending on the particular application of the package. In this regard, the sealing layer 22 may be fabricated from metallocene, polyethylene, metallocene polyethylene, or an ionomer thermoplastic such as SURLYN, available from DuPont. It is to be appreciated, however, that the sealing layer may be fabricated using any suitable fabrication process and from any material suitable for the particular application as would be apparent to one of skill in the art.

The tray and/or lid may be configured to have any suitable shapes desired for the particular product being packaged or stored. In one illustrative embodiment shown in FIGS. 1-3, the package 10 has a generally rectangular configuration. It is contemplated, however, that the package may employ any suitable configuration as would be apparent to one of skill in the art for packaging a product. For example, the package may be fabricated in other configurations that include, but are not limited to, square, triangular, round, circular, oval and non-circular configurations.

The package may be produced using preformed trays and lids on conventional tray sealing type equipment or on thermoform-fill-seal equipment. In one illustrative embodiment, a product may be introduced into the cavity 16 of the tray 12. The cavity 16 may then be sealed along a sealing flange 18 located about the cavity and within an interior region of the tray. The cavity 16 and the sealing flange 18 may be covered with a reclosable lid 14 that engages an interior portion of the tray external to the cavity.

In one embodiment, the cavity 16 may be hermetically sealed to prevent passage of gas and/or moisture to and from the cavity. This may be accomplished by covering the cavity 16 with a removable sealing layer 22 and hermetically sealing the sealing layer to the sealing flange 18 located within the interior region of the tray to form the seal.

In one embodiment for packaging a food product, the atmosphere of the cavity 16 may be modified prior to hermetically sealing the cavity. This may be accomplished using a sealing station (not shown) that is capable of evacuating the normal atmosphere surrounding the tray using a vacuum. In this regard, the tray 12 be located in a sealing chamber that includes a tray sealing system. An inert gas may then be injected into the chamber to equalize the pressure between the chamber and the atmosphere outside the chamber. The cavity 16 is then sealed with the sealing layer 22 to thereby seal the inert gas within the sealed cavity so as to help preserve the food product sealed within the cavity. It is to be appreciated that modification of the atmosphere may be accomplished using any suitable process as would be apparent to one of skill in the art.

It should be understood that the foregoing description of various embodiments of the invention are intended merely to be illustrative thereof and that other embodiments, modifications, and equivalents of the invention are within the scope of the invention recited in the claims appended hereto.

What is claimed:

1. A package for a product, the package comprising:

a tray including an upper peripherally extending surface and a lower surface, a cavity to receive the product therein, and a sealing flange that is to be used to form a first seal about the cavity, the sealing flange surrounding the cavity and being located below the upper surface and above the lower surface and within an interior region of the tray; and a reclosable lid constructed and arranged to lock to an interior portion of the tray below the upper surface to cover the sealing flange and the cavity;

the tray and the lid being constructed and arranged to form a second seal within the interior region that extends continuously about and surrounds the sealing flange when the lid is placed on the tray, one of the tray and the lid including no more than one continuous projection and the other of the tray and the lid including no more than one continuous channel, the projection and the channel constructed and arranged to mate in direct contact with each other when the lid is placed on the tray to form the second seal, the second seal being located below the sealing flange and above the lower surface.

2. The package according to claim 1, further comprising a removable sealing layer constructed and arranged to overlie the cavity and to be sealed to the sealing flange to form a hermetically sealed cavity.

3. The package according to claim 2, wherein the sealing layer includes a flexible film.

4. The package according to claim 2, wherein the product is a food product and the sealing layer is constructed and arranged to form a hermetically sealed cavity for the food product.

5. The package according to claim 1, wherein the cover is sealable directly to the sealing flange to seal the cavity.

6. The package according to claim 1, further comprising at least one interlock constructed and arranged to releasably secure the lid to the tray, the interlock being located external to the cavity at the interior portion of the tray.

7. The package according to claim 6, wherein the at least one interlock includes a snap-fit interlock.

8. The package according to claim 6, wherein the tray includes at least one tray interlock and the lid includes at least one lid interlock that is constructed and arranged to mate with the tray interlock to releasably secure the lid to the tray.

9. The package according to claim 8, wherein the at least one interlock includes a plurality of interlocks intermittently spaced about the cavity.

10. The package according to claim 9, wherein the tray includes a plurality of tray interlocks and the lid includes a plurality of lid interlocks that mate with the tray interlocks to releasably secure the lid to the tray.

11. The package according to claim 6, wherein the interlock is constructed and arranged to generate an audible sound when the lid is secured to and removed from the tray.

12. The package according to claim 1, wherein the second seal is constructed and arranged to reduce air flow to the cavity.

13. The package according to claim 1, wherein the tray is configured as a rigid or semi-rigid structure.

14. The package according to claim 13, wherein the lid is configured as a rigid or semi-rigid structure.

15. A food package, comprising:

a tray including a lower surface, a cavity and a sealing flange that extends about the perimeter of the cavity within an interior region of the tray, the cavity adapted to receive a food product therein, the sealing flange to form a primary seal that helps to maintain longer term preservation of the food product within the cavity; and a reclosable lid to cover the cavity and the sealing flange, the lid being constructed and arranged to engage with an interior portion of the tray to form a secondary seal when the lid is placed on the tray that extends continuously about and surrounds the cavity and the sealing flange to help maintain shorter term preservation of the food product after the primary seal has been broken, one of the tray and the lid including no more than one continuous projection and the other of the tray and the lid including no more than one continuous channel, the projection and the channel constructed and arranged to mate in direct contact with each other when the lid is placed on the tray to form the secondary seal, the secondary seal being located below the sealing flange and above the lower surface.

16. The food package according to claim 15, wherein the primary seal forms a hermetically sealed cavity and the secondary seal reduces air flow to the cavity.

17. The food package according to claim 15, wherein the projection and the channel are configured to create an interference fit between the tray and the lid.

18. The food package according to claim 15, wherein the tray includes the channel that surrounds the sealing flange and the lid includes the projection that is configured to mate with the channel to form the secondary seal.

19. The food package according to claim 15, wherein the tray includes an upper surface with the cavity disposed between the upper surface and the lower surface, the sealing flange located between the upper surface and the lower surface.

20. The food package according to claim 15, further comprising at least one interlock constructed and arranged to releasably secure the lid to the tray, the interlock being located within the interior region of the tray adjacent the secondary seal.

21. The food package according to claim 20, wherein the at least one interlock includes a snap-fit interlock.

22. The food package according to claim 20, wherein the tray includes at least one tray interlock and the lid includes at least one lid interlock that is constructed and arranged to mate with the tray interlock to releasably secure the lid to the tray.

23. The food package according to claim 22, wherein the at least one interlock includes a plurality of interlocks intermittently spaced about the cavity.

24. The food package according to claim 23, wherein the tray includes a plurality of tray interlocks and the lid includes a plurality of lid interlocks that mate with the tray interlocks to releasably secure the lid to the tray.

25. The food package according to claim 20, wherein the interlock is constructed and arranged to generate an audible sound when the lid is secured to and removed from the tray.

26. The food package according to claim 15, further comprising a removable sealing layer constructed and arranged to overlie the food cavity and to be sealed to the sealing flange to form a hermetically sealed cavity.

27. The food package according to claim 26, wherein the tray and the lid are configured as rigid or semi-rigid structures, and wherein the sealing layer includes a flexible film.

28. A method of packaging a product, the method comprising acts of:

(a) providing a tray that includes a lower surface and a cavity adapted to receive the product therein;

(b) introducing the product into the cavity;

(c) sealing the cavity along a first seal that extends continuously about and surrounds the cavity and is located within an interior region of the tray; and (d) covering the cavity and the first seal with a reclosable lid that engages an interior portion of the tray external to the cavity to removably secure the lid to the tray and form a second seal within the interior region that extends continuously about and surrounds the first seal, one of the tray and the lid including no more than one continuous projection and the other of the tray and the lid including no more than one continuous channel, the projection and the channel mating in direct contact with each other when the lid is placed on the tray to form the second seal, the second seal being located below the first seal and above the lower surface.

29. The method according to claim 28, wherein act (c) includes hermetically sealing the cavity.

30. The method according to claim 29, wherein act (c) includes covering the cavity with a removable sealing layer and hermetically sealing the sealing layer to a sealing flange located within the interior region of the tray to form the first seal.

31. The method according to claim 30, wherein the sealing flange is located between an upper surface and the lower surface of the tray.

32. The method according to claim 31, wherein the sealing layer is positioned within the interior region of the tray between the lid and the cavity.

33. The method according to claim 28, wherein the projection and the channel create an interference fit between the tray and the lid.

34. The method according to claim 28, wherein the second seal reduces air flow to the cavity.

35. The method according to claim 28, wherein act (d) includes locking the lid to the tray with at least one interlock located within the interior region of the tray.

36. The method according to claim 35, wherein the interlock is located external to the cavity.

37. The method according to claim 28, wherein the product is a food product and act (b) includes introducing the food product into the cavity.

38. The method according to claim 37, further comprising an act (e) of modifying the atmosphere of the cavity prior to act (c) to preserve the food product.

39. The package according to claim 1, wherein the projection and the channel are configured to create an interference fit to form the second seal.

* * * * *